United States Patent [19]

Kivenson

[11] 4,187,463

[45] Feb. 5, 1980

[54] COUNTERFEIT DETECTOR FOR PAPER CURRENCY

[76] Inventor: Gilbert Kivenson, 22030 Wyandotte St., Canoga Park, Calif. 91303

[21] Appl. No.: 898,376

[22] Filed: Apr. 20, 1978

[51] Int. Cl.[2] ..... G07O 7/00

[52] U.S. Cl. ..... 324/228; 209/534

[58] Field of Search ..... 324/200, 228; 73/150 R, 73/150 A; 209/534; 194/100 R, 97 R, 101

[56] References Cited

FOREIGN PATENT DOCUMENTS 821619 10/1951 Fed. Rep. of Germany ..... 324/200

OTHER PUBLICATIONS

Stipulation; Civil Action #44,022, U.S. District Ct., Northern District of Calif., Micro-Magnetic Industries vs. National Rejectors; Filed Jan. 10, 1970, 8 pages.

*Primary Examiner*—Rudolph V. Rolinec
*Assistant Examiner*—Walter E. Snow

[57] ABSTRACT

A detector apparatus for counterfeit paper currency comprising a clamp and torsion pendulum assembly for holding a note to be tested, a moveable magnetic field source mounted so that it can be brought into contact with the note and then withdrawn, and indicating means for detecting and measuring deflection of the note.

1 Claim, 4 Drawing Figures

COUNTERFEIT DETECTOR FOR PAPER CURRENCY

BACKGROUND OF THE INVENTION

The present invention relates to counterfeit detectors for United States paper currency. With modern improvements in copying methods it has become relatively easy for counterfeiters to reproduce paper currency. The production of passable copies no longer requires the work of a skilled engraver. Photographic methods can be used to make accurate plates in a very short time. In addition electrostatic copying equipment has been so perfected that reasonable color copies of legitimate notes can be made easily and rapidly. As a result there has been a steadily growing amount of false currency and an increased cost to merchants and others who must absorb the loss when these copies are passed.

Some methods to detect counterfeit employ special illumination. Because United States bills are printed on rag bond and use no brighteners, they possess characteristic optical properties. Under ordinary light they will have an off-white appearance. Under ultraviolet illumination they will not fluoresce. Papers containing wood pulp and brighteners will not have these properties. A new paper has become available to some counterfeiters however which more closely resembles that used for legitimate notes.

Despite the use of optical machines the most effective detection of counterfeit to date has been by highly trained observers who look for small imperfections in the printing. It is an object of this invention to provide a simple apparatus whereby persons of limited training will be able to check suspected paper currency. It is another object of this invention to force would-be counterfeiters to meet new standards in addition those involved with paper quality and printing accuracy, thereby increasing the difficulty of producing passable imitations.

DESCRIPTION OF THE DRAWINGS

The invention will be explained with reference to FIGS. 1 through 4.

DESCRIPTION OF THE INVENTION

Methods for the detection of counterfeit paper currency have heretofore depended on some property of the paper or on the quality of the printing. The present invention, by contrast, relies on a characteristic of the ink. Unlike many substances used in general printing or in foreign currency the ink employed for United States bills has magnetic properties. Paper imprinted with this material will be attracted by a magnet. The measurement of this attraction in the present invention serves to distinguish genuine United States notes from currently made imitations. Should counterfeiters at a later date add magnetic materials to their inks in an effort to defeat the present invention, it would still be necessary for them to determine the proper amount of additive. This requirement added to the need for suitable rag bond paper makes the production of passable counterfeit considerably more difficult.

The magnetic susceptability of the ink layer on United States notes is relatively low. To measure the attraction of a note by a magnet therefore requires sensitive apparatus. It is desirable however that the test be simple and easily performed and that the equipment be rugged enough to withstand everyday use under the normal conditions found in a business establishment. The present invention meets these objectives by the use of a torsion balance system.

Figure 1:
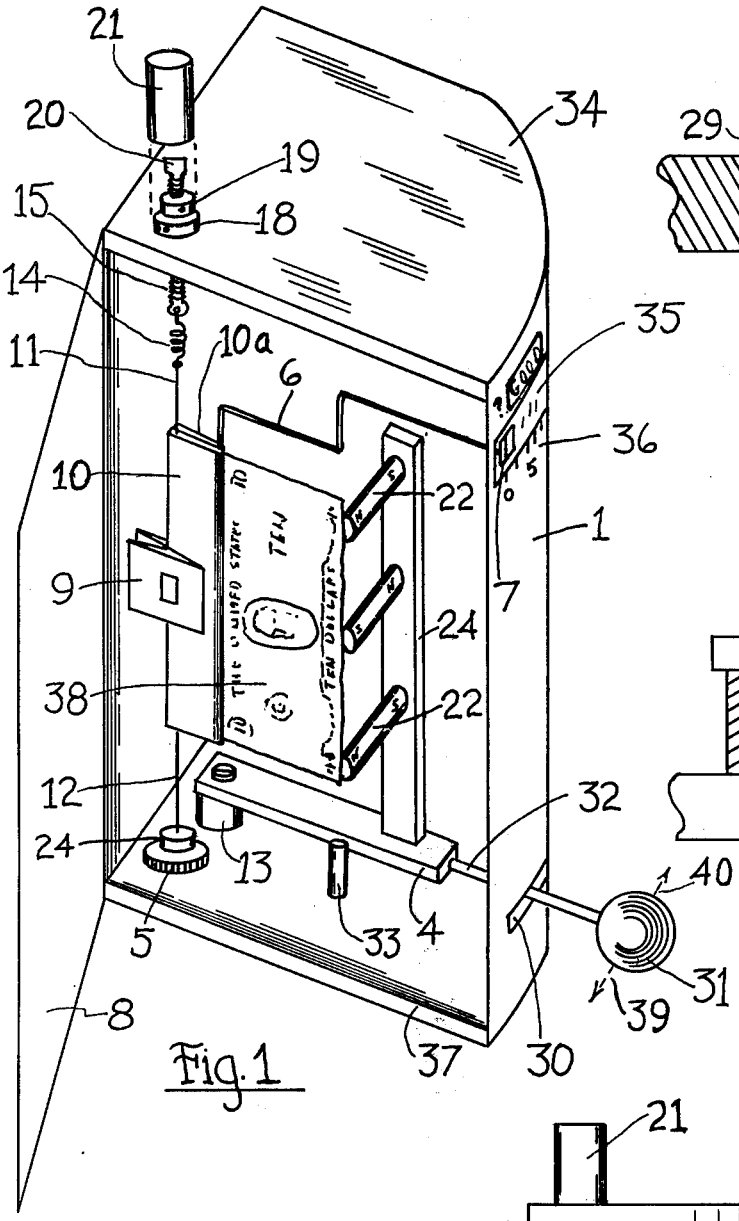
FIG. 1 is a perspective view of a preferred embodiment of the invention.

Referring now to FIG. 1, the housing 1 encloses the permanent magnets 22 which are affixed to an upright member 24. The material of member 24 is preferably ferromagnetic inorder to intensify the fields of magnets 22 as is well known in the design of magnet system. Member 24 is mounted on the trolley 4 which is free to move in a horizontal arc about support 13.

A clamping system comprised of the clamp 9 and the jaws 10 and **10*a* is also contained within housing 1. The clamping system is rotatably suspended by the top fiber 11 and the bottom fiber 12. The fibers are affixed to the jaws 10 and 10*a* so as to not interfere with their opening when the clamp 9** is squeezed.

Spring 14 is used to apply tension to the fibers 11 and 12 by means of the threaded extension 15 which passes through the upper plate 34 of the housing. For adjusting the tension in the fibers the tab 20 is held firmly while the main tensioning nut 18 is turned. The auxilliary nut 19 is used to prevent tensioning nut 18 from loosening during day to day use of the detector. A cap 21 fits over the tensioning adjustment assembly for additional protection.

Figure 2:
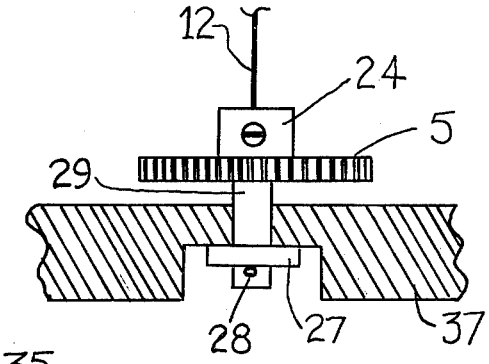
FIG. 2 is a detail view of a suspension system which is part of the invention shown in FIG. 1.
Figure 4:
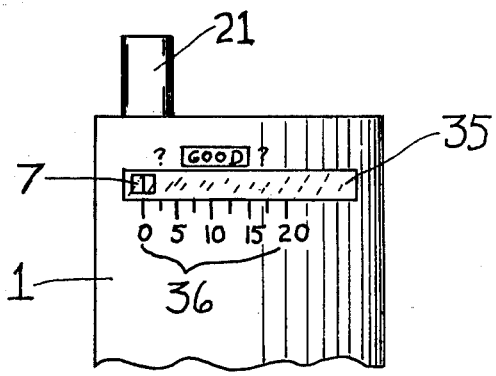
FIG. 4 is a partial front view of the invention shown in FIG. 1.

The lower fiber 12 terminates in the coupling 24 which is integral with a zero adjust wheel 5 and a shaft 29 as is shown in FIG. 2. A washer 27 and pin 28 restrain the shaft 29 from upward, axial motion after tension is applied. Turning of the zero adjust wheel 5 will produce horizontal, rotary displacement of the suspended clamping system and permit the user to position the clamp and its jaws at any desired point within its allowable range of travel. A pointer 6 is fixed to one of the clamping jaws and terminates in the target 7. A window 35 in the housing permits the user to see a fiducial line marked on the target. A scale 36 is marked on the housing as is shown in FIGS. 1 and 4. The position of target 7 with respect to the zero mark of scale 36 is used to guide the operator in the manipulation of the zero adjust wheel 5.

Figure 3:
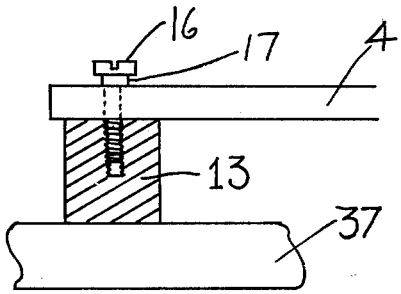
FIG. 3 is a detail of a trolley which is part of the invention shown in FIG. 1.

The trolley 4 is mounted on support 13 by means of a bolt 16 and a spacer 17 which serve to nold the trolley in place but still permit horizontal, rotary motion as is shown in FIGS. 1 and 3. Extension 32 joints the free end of trolley 4 to the knob 31 through the slot 30 in housing 1. A stop 33 limits trolley motion in the direction 39. A door 8 permits access to the interior of the detector for placing and removing currency samples and for zero adjustments. Door 8, when shut, helps maintain still air conditions within housing 1.

In operation of the invention the door is opened, the bill to be checked, 38, is clamped between the jaws 10 and **10*a* and the door closed. The magnets 22 are made to just contact the bill by moving the control knob clockwise, in the direction 39 shown in FIG. 1, until the trolley touches stop 33. A few seconds are now required until air currents inside the housing diminish. The target will now be at rest so that its fiducial line will be at or very near zero. Knob 31 is now slowly moved counterclockwise in the direction 40. If the bill is genuine, it will be pulled by the magnets 22 and will follow the magnet assembly until the increasing torque produced by the upper and lower suspension fibers is equal to the moment of the magnetic force about the axis of the suspension. As the bill passes this point, it will fall away from the magnets and return to its zero position. The operator observes any movement of the target 7 and can determine whether or not the bill responds to the magnets and at what point along scale 36** it falls away if it does respond. No response will indicate counterfeit. A fall away point greater than normal will cause him to put the bill aside for further examination.

The invention as described represents a preferred but non-limiting embodiment. It would for example be possible to include one or more of the following modifications:

a. The fibers 11 and 12 may be replaced by thin tapes which would provide non-linearly increasing restoring moment as they are twisted. This would have the effect of decreasing oscillation of the clamping system and stabilizing the preset zero.

b. The fibers 11 and 12 might also be replaced by upper and lower bearing assemblies along with a helical spring to provide restoring torque to the clamping system. One suitable bearing assembly, well known in the art of sensitive instrument suspension construction, is comprised of sharpened pivots resting in conically shaped sockets.

c. The pointer, target and scale shown in FIG. 1 might be replaced by a stationary source of collimated light, a reflective surface positioned on the clamping assembly and a calibrated screen.

d. It would also be possible to mount the clamping system horizontally and to employ a counterweight system to achieve zeroing. In this configuration of the invention the magnet structure would be moveable in vertical plane.

e. Moveable electromagnets and fixed electromagnets of variable field strength might also be employed as the basis of other embodiments of the invention.

The above and other modifications would be possible without departing from the spirit of the present invention as described in the specifications and as claimed below.

I claim:

1. In a counterfeit detector for United States paper currency which makes use of the magnetic properties of the imprinted ink as its operating principle, an assembly comprised of the following:

a. a pinch clamp for firmly grasping a sample of paper currency, said clamp being mounted between flexible suspension elements which are in turn supported at their extremities and maintained in tension, said flexible suspension elements permitting elastically restrained motion of the pinch clamp and its grasped sample of paper currency;

b. an indicating means mounted on said clamp for the measurement of clamp motion;

c. a moveably mounted magnet which can be brought into contact with said currency sample and then drawn away, inducing initial adherence between genuine currency and said magnet, and then, a separation with increased magnet movement because of increased counter torque of said flexible suspension elements;

d. a scale fixedly mounted with reference to said indicating means and calibrated to facilitate the reading of the separation point, said point being within a limited range of clamp motion if the currency being tested is not counterfeit.

* * * * *